United States Patent [19]

Hiratsuka et al.

[11] Patent Number: 4,803,514

[45] Date of Patent: Feb. 7, 1989

[54] MULTI-COLOR IMAGE FORMING METHOD AND APPARATUS

[75] Inventors: Seiichiro Hiratsuka; Satoshi Haneda; Hisashi Shoji, all of Tokyo, Japan

[73] Assignee: Konishiroku Photo Industry Co., Ltd., Tokyo, Japan

[21] Appl. No.: 874,177

[22] PCT Filed: Oct. 21, 1985

[86] PCT No.: PCT/JP85/00588

§ 371 Date: Aug. 5, 1986

§ 102(e) Date: Aug. 5, 1986

[87] PCT Pub. No.: WO86/02745

PCT Pub. Date: May 9, 1986

[30] Foreign Application Priority Data

Oct. 22, 1984 [JP] Japan ..... 59-220387
Nov. 13, 1984 [JP] Japan ..... 59-237581
Dec. 5, 1984 [JP] Japan ..... 59-255795

[51] Int. Cl.[4] ..... G03G 15/01

[52] U.S. Cl. ..... 355/4; 355/3 R; 355/3 CH; 355/14 CH; 118/645; 430/42

[58] Field of Search ..... 355/3 R, 4, 14 R, 14 E, 355/3 DD, 14 D, 3 CH, 14 CH; 118/645; 430/42

[56] References Cited

U.S. PATENT DOCUMENTS 3,815,988 6/1974 McVeigh et al. ..... 355/4 X
4,179,209 12/1979 Goren ..... 355/4 X
4,204,728 5/1980 Goshima et al. ..... 355/4
4,407,917 10/1983 Sakai ..... 355/4 X
4,472,047 9/1984 Stoudt ..... 365/4

FOREIGN PATENT DOCUMENTS 51-94936 8/1976 Japan .
52-74341 6/1977 Japan .
53-144748 12/1978 Japan .
58-154855 9/1983 Japan .
59-129874 7/1984 Japan .
59-154467 9/1984 Japan .

*Primary Examiner*—A. C. Prescott
*Attorney, Agent, or Firm*—Jordan B. Bierman

[57] ABSTRACT

Herein disclosed are method of and apparatus for forming a multicolor image by repeating such whole-surface exposure and development of a multicolor image forming photosensitive member (4), which has: a photoconductive layer (1) sandwiched vertically between an insulating layer (2) and a conductive layer (3), at least one of said insulating layer (2) and said conductive layer (3) being light transmissive and being composed of a plurality of kinds of filters, as will produce a potential pattern in a portion of a specific kind one of said filters, after said photosensitive member (4) has been charged and subjected to an image exposure, thus adjusting the light quantity and wavelength distribution of said whole-surface exposure, the developing conditions or the developing electric field.

8 Claims, 13 Drawing Sheets

E(V)
1000
500
0
B R G B R
5
6
61
7
8Y
9
LR
LB
FB
TY
1
2
3
4

MULTI-COLOR IMAGE FORMING METHOD AND APPARATUS

TECHNICAL FIELD

The present invention relates to a multi-color image forming method and an apparatus using a photosensitive member which is suitable for forming a multi-color image by the electrophotography.

BACKGROUND ART

With a view to producing a multi-color image by the electrophotography, there have been proposed in the prior art a number of methods and apparatus to be used for the former, which can generally be divided roughly into the following ones. One of these methods is conducted by using a single photosensitive member and by repeating formation of a latent image by an image exposure and a development with a color toner in accordance with the to a transfer member upon each development to effect the color superposition on the transfer member. And, the second method produces a multicolor image by using an apparatus equipped with photosensitive members in a number according to the number of separated colors, by exposing the photosensitive members simultaneously to optical images in individual colors, by developing the latent images formed on the individual photosensitive members with color toners, and by transferring the images sequentially to a transfer member to superpose the colors.

The first method is accompanied by a serious defect that the plural latent image forming and developing steps have to be repeated to take a long time for the image recording operation so that it is remarkably difficult to speed up. On the other hand, the second method is advantageous in the speed because the plural photosensitive members are used in parallel, but is short of practicability because it requires the plural photosensitive members, optical systems and developing means so that its apparatus is complicated and large-sized to raise the production cost. Moreover, both of those two methods are seriously defective in that they find it difficult to register the images being formed and transferred repeatedly several times so that they cannot completely prevent the color misregistration of the image, and in that they find it difficult to adjust the color reproduction and balance.

In order to drastically solve those problems, it is sufficient to record a multi-color image on a single photosensitive member by a single image exposure, but it is the present technical state that such a method is not developed yet.

DISCLOSURE OF INVENTION

The present invention has been conceived in view of the background so far described and contemplates to provide a multi-color copying apparatus which can form a multi-color image on a single photosensitive member at a high speed by a single image exposure, can easily adjust the reproduction density and the color balance of an original image and can make its construction compact. According to the present invention, there is provided a method of forming a multicolor image by repeating such whole-surface exposure and development on a multicolor image forming photosensitive member, which has: an insulating layer on one side of a photoconductive layer; a conductive layer on the other side, at least one of said insulating layer and said conductive layer being light transmissive and being composed of a plurality of kinds of filters, as will produce a potential pattern in a portion of a specific kind one of the filters of said photosensitive member, after said photosensitive member has been charged and subjected to an image exposure, characterized in that at least one of said image exposing, whole-surface exposing and developing steps is made variable to control the color reproduction of said multicolor image.

In the aforementioned steps, moreover, the multicolor image forming method of the present invention is characterized in that the density of a subsequent development is adjusted by changing the quantity of light and/or wavelength distribution of said whole-surface exposure.

In the aforementioned steps, furthermore, the multicolor image forming method of the present invention is characterized in that the color reproduction of said multicolor image is adjusted by changing the conditions of said development.

In the aforementioned steps, furthermore, the multicolor image forming method of the present invention is characterized in that the color reproduction of said multicolor image is adjusted by changing a developing electric field to be established between said photosensitive member and a developer carrier of a developing device.

Furthermore, the multi-color image forming method of the present invention is characterized by repeating such whole-surface exposure and development on a multicolor image forming photosensitive member, which has: an insulating layer on one side of a photoconductive layer; a conductive layer on the other side, at least one of said insulating layer and said conductive layer being optically light transmissive and being composed of a plurality of kinds of filters, in a manner to recharge said photosensitive member before the second and later whole-surface exposures as will produce a potential pattern in a portion of a specific kind one of the filters of said photosensitive member, after said photosensitive member has been charged and subjected to an image exposure, characterized in that at least one of said charging conditions is made variable to adjust the color balance of said multicolor image.

According to the present invention, furthermore, there is provided a copying apparatus for forming a multicolor image by repeating such whole-surface exposure and potential pattern development on a multicolor image forming photosensitive member, which has: an insulating layer on one side of a photoconductive layer; a conductive layer on the other side, at least one of said insulating layer and said conductive layer being light transmissive and being composed of a plurality of kinds of filters, as will produce a potential pattern in a portion of a specific kind one of the filters of said photosensitive member, after said photosensitive member has been charged and subjected to an image exposure, characterized in that image exposing means for projecting an original to effect said image exposure can change the quantity or wavelength distribution of a light for projecting said original.

Furthermore, the multicolor copying machine of the present invention is characterized in that said image exposing means includes means interposed between said original and said photosensitive member for changing the quantity or wavelength distribution of the light which is incident upon said photosensitive member.

Furthermore, the multicolor copying machine of the present invention is characterized by means for subjecting said photosensitive member to a uniform exposure substantially simultaneously with said image exposure to adjust the quantity or wavelength distribution of the exposing light by said means.

BEST MODE FOR CARRYING OUT THE INVENTION

The present invention will be described in the following in connection with the embodiments thereof with reference to the accompanying drawings.

Incidentally, the following description is directed to both a full-color reproducing photosensitive member, which uses individual red (R), green (G) and blue (B) filters for substantially transmitting exclusively red, green and blue light, respectively, as color separating filters, and a multicolor image forming method using that photosensitive member, but the colors of the color separating filters and the colors of toners to be used in combination of the former colors should not be limited thereto.

Figure 1:
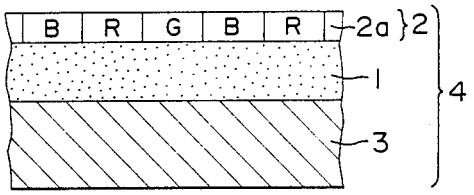
FIGS. 1 to 13 are sectional views schematically showing respective examples of the laminated structure of a photosensitive member to be used in the method of the present invention.
Figure 2:
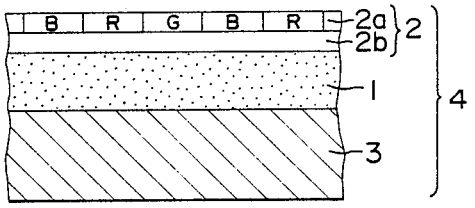
Figure 3:
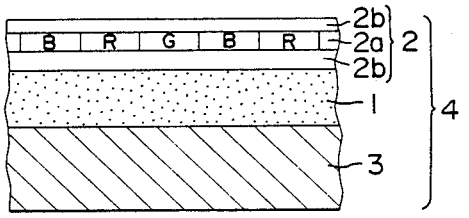
Figure 4:
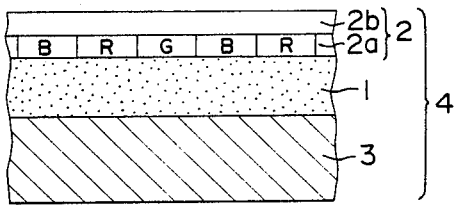
Figure 5:
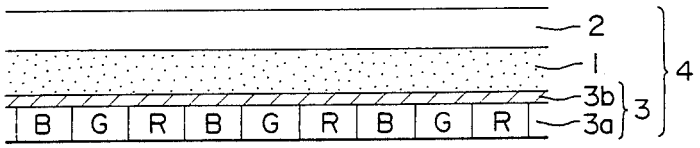
Figure 6:
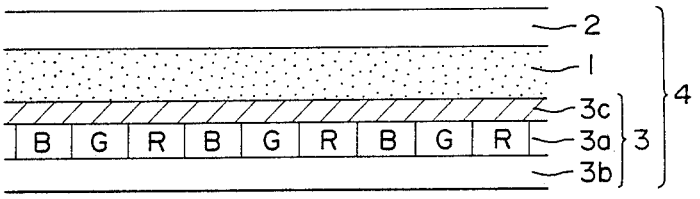
Figure 7:
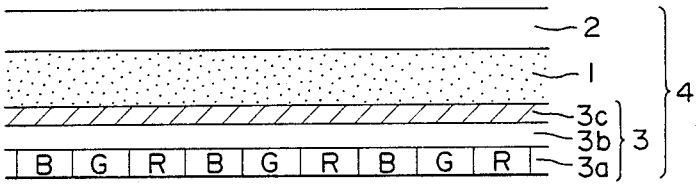
Figure 8:
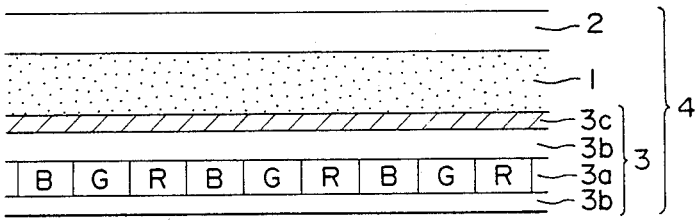
Figure 9:
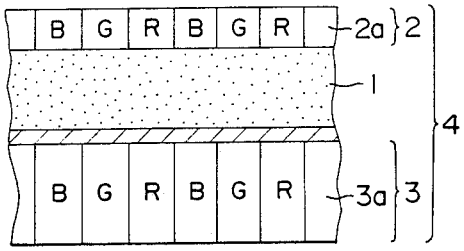
Figure 12:
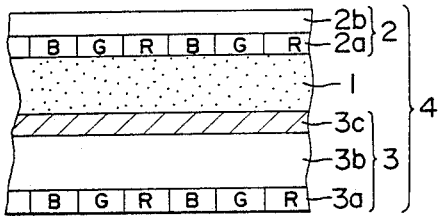
Figure 10:
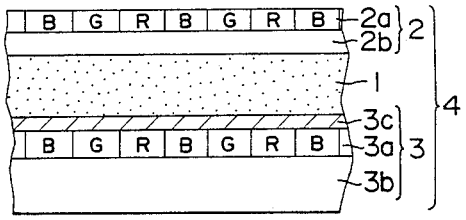
Figure 13:
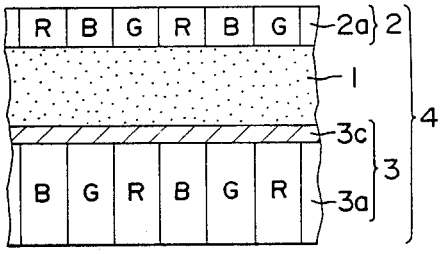
Figure 11:
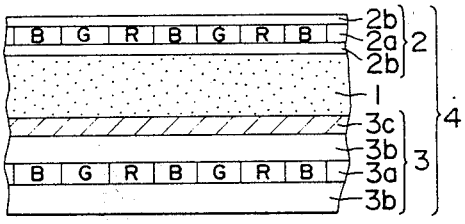

In FIGS. 1 to 13, reference numeral 1 denotes a photoconductive layer which is made of: a photoconductor such as sulfur, selenium, amorphous silicon or an alloy containing sulfur, selenium, tellurium, arsenic or antimony; an inorganic photoconductor such as an oxide, ionide, sulfide or selenide of a metal such as zinc, aluminum, antimony, bismuth, cadmium or molybdenum; or an organic photoconductor prepared by dispersing an organic photoconducting substance such as vinylcarbazole, anthracene phthalocyanine, trinitrofluorenon, polyvinylcarbazole, polyvinylanthracene or polyvinylpyrene into an insulating binder resin such as polyethylene, polyester, polypropylene, polystyrene, polyvinylchrolide, polyvinylacetate, polycarbonate, acrylic resin, silicone resin, fluorine-contained resin or epoxy resin. Reference numerals 2 and 3 denote an insulating layer and a conductive layer, respectively. Moreover, the insulating layer 2 appearing in FIGS. 1 to 4 and FIGS. 9 to 13 is light transmissive and is composed of filter layer 2*a* having a distribution of color separating filters of red (R), green (G) and blue (B). Of these, the insulating layer 2 of FIGS. 1, 9 and 13 is wholly composed of the filter layer 2*a* and can be prepared by applying an insulating substance such as a transparent resin, which is colored by adding coloring agents such as red, green and blue dyes, in a predetermined pattern on the photoconductive layer 1 by means such as printing means. On the other hand: the insulating layer 2 of FIGS. 2 to 4 and FIGS. 10 to 12 is partially composed of the filter layer 2*a;* the insulating layer 2 of FIGS. 2 and 10 is prepared by forming a transparent insulating layer 2*b* of a transparent resin or the like on the photoconductive layer 1 and by applying the coloring agents in a predetermined pattern to form the filter layer 2*a* on the insulating layer 2*b* by means such as printing means or vapor deposition means likewise the method of forming the aforementioned filter layer the insulating layer 2 of FIGS. 3 and 11 is prepared by forming the transparent insulating layer 2*b* on the filter layer 2*a;* and the insulating layer 2 of FIGS. 4 and 12 is prepared by forming the filter layer 2*a* on the photoconductive layer 1 likewise the aforementioned method and by forming the transparent insulating layer 2*b* on the filter layer 2*a*. The transparent insulating layer 2*b* sandwiched between the photoconductive layer 1 and the filter layer 2*a* of the insulating layer 2 of FIGS. 2, 3, 10 and 11 may be made of a transparent adhesive layer in its entirety or partially at the side of the photoconductive layer 1. In other words, this insulating layer 2 is once formed into film and then adhered to the photoconductive layer 1 with the transparent adhesive agent. As is different from the foregoing ones, the insulating layer 2 of FIGS. 5 to 8 has no filter layer and may be not only light transmissive but also light nontransmissive. The conductive layer 3 of FIGS. 1 to 4 is light nontransmissive, conductive layer which is wholly made of either a metal such as aluminum, iron, nickel or copper or their alloy likewise the photosensitive members of the prior art. On the contrary, the conductive layer 3 of FIGS. 5 to 13 is formed by laminating a light transmissive, conductive film 3*c* contacting with the photoconductive layer 1 and made of an evaporated layer or a spattering layer of either a metal such as alminum, silver, lead, zinc, nickel, gold, chromium, molybdenum, titanium or platinum, or an evaporated layer of a metallic oxide such as indium oxide, tin oxide or indium-zin oxide; and a filter layer 3*a* like that of the aforementioned insulating layer 2; and/or a transparent layer 3*b*. The conductive layer 3 having such filter layer 3*a* may omit the conductive film 3*c* in case the filter layer 3*a* and the transparent layer 3*b* are made of a conductive substance such as a conductive resin.

The present invention uses the photoconductive member 4 having the laminated structure thus far described such that the member 4 is formed into a cylindrical, belt or plate shape.

Figure 14:
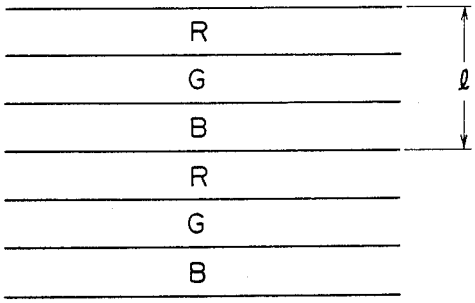
FIGS. 14 to 16 are top plan views showing the filter layers of respective examples of the distribution of color separating filters.
Figure 15:
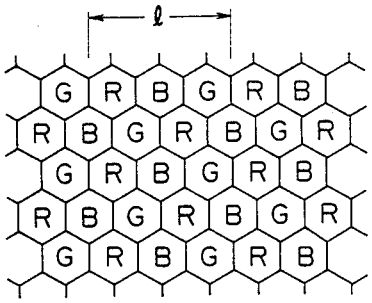
Figure 16:
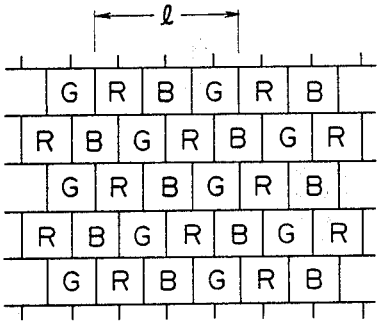

Incidentally, in case the photoconductive layer 1 has bad charge retainability, a thin insulating layer may be sandwiched between the conductive layer 3 and the photoconductive layer 1, as well known in the art. Moreover, the filter layer 2a of the insulating layer 2 and the filter layer 3a of the conductive layer 3 of photosensitive member 4 of FIGS. 9 to 12 has the patterns of the R-, G- and B-filters arrayed in absolutely the same order so that the filters in the same colors correspond to each other. In the photosensitive member 4 of FIG. 13, however, the array order is different so that the combinations in different colors correspond to each other. The shape and array of the R-, G- and B-filters in the filter layers 2a and 3a are not especially limitative, but the stripe-shaped array, as shown in FIG. 14, is preferable in its simplicity in pattern formation whereas the mosaic-shaped array, as shown in FIG. 15 or 16, is preferable in its appearance of a delicate multicolor image. The array of the R-, G- and B-filters in not only the mosaic distribution but also the stripe distribution may be oriented in any direction with respect to the extension of the photosensitive member. For example, in the case of a rotating drum-shaped photosensitive member, more specifically, the longitudinal direction of the stripes may be parallel, perpendicular or helical with respect to the axis of the photosensitive member. However, the individual sizes of the R-, G- and B-filters will drop the resolution and color-mixability of the image to deteriorate the picture quality, if they are excessively enlarged, and will make a color portion liable to be influenced by adjoining another or make it difficult to form the distribution pattern of the filters if they are excessively reduced to a size equal to or smaller than the diameter of toner particles. In the case of three kinds of filter distribution, as shown, the length l of one cycle of repetitions of of the array is preferred to be as wide or large as 30 to 300 μm. Incidentally, since the combination of the color separating filters is not limited to the three kinds, i.e., R, G and B but can be changed in the kind and number colors, the above-specified length l has its preferable range changed for another kind and number.

Next, the multicolor image forming method using the aforementioned photosensitive member 4 according to the present invention will be described with reference to FIGS. 17(A) to 17(E) and 18. Incidentally, FIGS. 17(A) to 17(E) shows an example, in which a photoconductor of an n-type semiconductor such as cadmium sulfide is used as the photoconductive layer 1 of the photosensitive member 4, and the same reference numerals appearing in FIGS. 17(A) to 17(E) also denote the parts having the same functions.

Figures 17A, 17B, 17C, 17D, 17E:
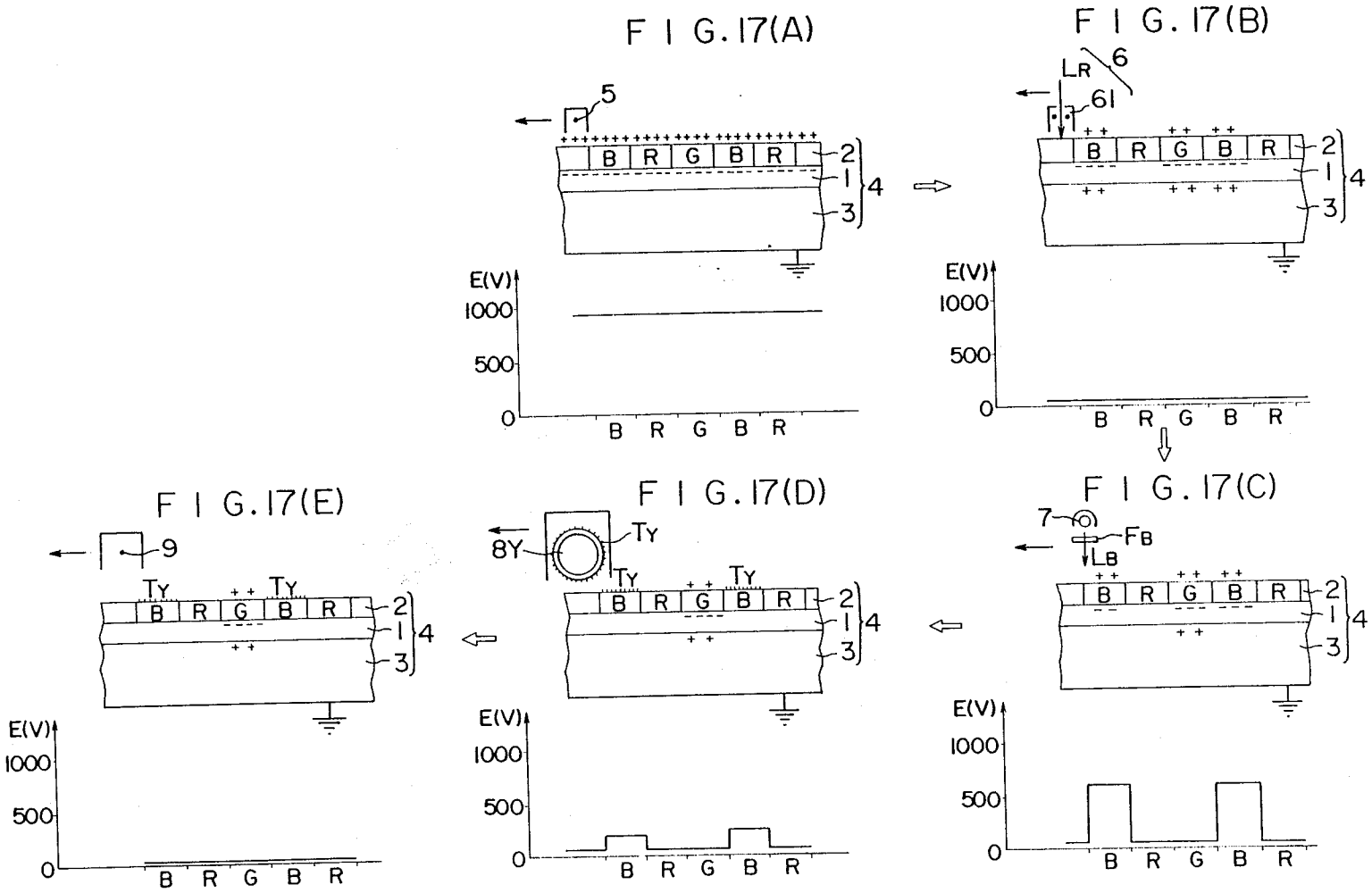
FIGS. 17(A) to 17(E) are step diagrams for explaining the multicolor image forming method of the present invention.

FIG. 17(A) shows the state in which the photosensitive member 4 is uniformly charged from the side of the insulating layer 2 by the positive corona discharge of a charger 5. In this state, positive charges are established in the surface of the insulating layer 2, and negative charges are accordingly induced in the boundary between the photoconductive layer 1 and the insulating layer 2, so that the photosensitive member 4 has a uniform surface potential E, as depicted in the graph.

For convenience of description, FIG. 17(B) shows the change in the state of the photosensitive member 4 charged by a red component $L_R$ of the image exposing light which is incident upon the aforementioned charged portion from an image exposing device 6, for example. In this image exposing device 6, a discharger 61 subjects the photosensitive member 4 to an image exposure while accomplishing an a.c. discharge or a d.c. discharge of charges of a polarity opposite to that of the charger 5. The photosensitive member 4 in this case has such a layer structure, in which the insulating layer 2 has the filter layer 2a, as is shown in FIGS. 1 to 4 or FIGS. 9 to 13. In case the photosensitive member 4 has such a layer structure, in which the insulating layer 2 does not has any filter layer, as is shown in FIGS. 5 to 8, the image exposing light is given from the side of the conductive layer 3 having the filter layer 3a. In the photosensitive members 4 of FIGS. 9 to 13, incidentally, the image exposing light may be given from the side of the conductive layer 3. Since, in the shown example, the red component $L_R$ of the image exposing light transmits through the R-filter portion of the insulating layer 2 to render the portion of the underlying photoconductive layer 1 conductive, the negative charges in the boundary between the photoconductive layer 1 and the insulating layer 2 disappear in the R-filter portion. Since the G- and B-filter portions do not allow transmission of the red component $L_R$, on the other hand, the negative charges of the photoconductive layer 1 are left as they are in those portions. As a result, the surface potential E of the photosensitive member 4 is made uniform by the discharge of the discharger 61 in not only the R-filter portion, in which the negative charges have disappeared, but also the G- and B-filter portions retaining the negative charges. This is because the positive charges in the surface of the insulating layer 2 distribute according to the negative charges remaining in the boundary between the photoconductive layer 1 and the insulating layer 2 so that they remain balanced. The green and blue components of the image exposing light also produce similar results. As a result, the state of the surface of the photosensitive member 4, which has been subjected to the image exposure by the image exposing device 6, does not function as an electrostatic image. This is similar to the case in which the image exposing light is given from the side of the conductive layer 3 having the filter layer 3a. The description thus far made is directed to the procedures for a primary latent image formation.

FIG. 17(C) shows the change in the charged state of the photosensitive member 4 on which a blue light $L_B$ obtained by transmitting the light of a lamp 7 through a filter $F_B$ has been incident on the side having subjected to the aforementioned image exposure. This whole-surface exposure may be conducted from the side opposite to the image exposure for the photosensitive members 4 of FIGS. 9 to 13. The blue light $L_B$ does neither transmit through the R- and G-filter portions not cause no change in these portions but transmits through the B-filter portion to render the photoconductive layer 1 in that portion conductive. Then, the charges in the vertical boundary of the photoconductive layer 1 of the B-filter portion are neutralized. As a result, there appears in the B-filter portion a potential pattern which has been formed on the surface of the insulating layer 2 by the preceding image exposure to form an image in a color complementary to the blue. This is depicted in the lower graph of FIG. 17(C).

Figure 18:
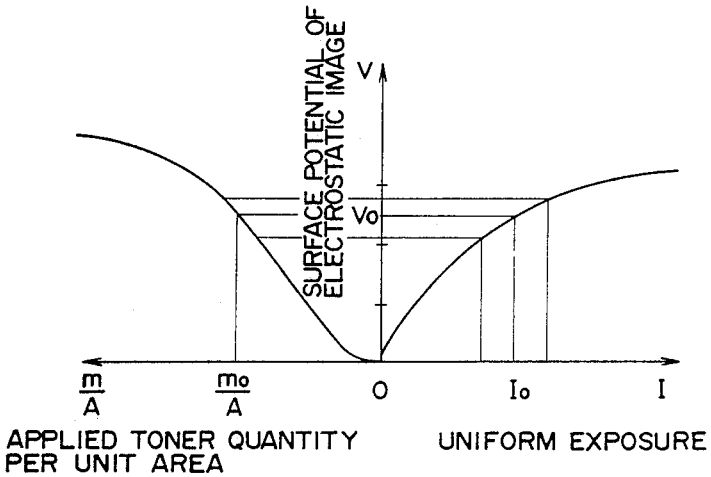
FIG. 18 is a graph depicting the relationship between the whole-surface exposure, the electrostatic image potential and the quantity of toner applied.

The potential in this electrostatic image and accordingly the quantity of the toner applied for the development will change in accordance with the quantity of light of the whole-surface exposure, as shown in FIG. 18, so that the quantity of the toner applied, i.e., the development density at a subsequent developing step is regulated by adjusting the quantity of light of whole-surface exposure by suitable means including the control of the quantity of light emitted from the lamp 7 or its aperture. This regulation of the developing density can be effected likewise the case of adjusting the quantity of light by changing the wavelength distribution of the whole-surface exposure. For example, a halogen lamp or the like to be used as a light source of the whole-surface exposure can be changed in not only its light quantity but also its wavelength distribution by making variable the voltage applied, and a light source having a filter for the whole-surface exposure can have its wavelength distribution changed by changing the filter. Since the photosensitivity of the photosensitive member also has a wavelength distribution, the potential of the potential pattern of the photosensitive member can change with the change in the wavelength distribution of the whole-surface exposure to regulate the developing density.

FIG. 17(D) shows the state in which the electrostatic image formed by the whole-surface exposure of the blue light $L_B$ is developed by a developing device 8Y containing a yellow toner $T_Y$ charged negative and complementary to the blue color. The yellow toner $T_Y$ is applied only to the surface of the insulating layer 2 of the B-filter portion, which has its potential changed by the whole-surface exposure of FIG. 17(C), but not to the R- and G-filter portions where no potential has changed. As a result, the photosensitive member 4 has its surface formed with the yellow toner image in one separated yellow color. The potential pattern formed by the whole-surface exposure is partially erased by the development but will not usually become uniform. This situation is depicted in the lower graph of FIG. 17(D).

FIG. 17(E) shows the state in which the surface potential of the photosensitive member 4 developed is made uniform by the discharge of a charger 9 similar to that of the discharger 61 of the image exposing device 6. This step exerts no influence upon the charge distributions the R- and G-filter portions between the insulating layer 2 and the photoconductive layer 1. In other words, that step prevents a toner in a different color from being applied in a subsequent development to the toner image having been previously developed and from becoming indistinct in the color. Incidentally, the discharger 61 of the image exposing device 6 can take place of the charger 9.

Next, the photosensitive member 4 having been formed with the yellow toner image and held in the state of FIG. 17(E) is subjected to the whole-surface exposure with the green light which is obtained by transmitting the light of the lamp 7 through the green filter. As a result, a potential pattern for forming an image in the color complementary to green appears in the G-filter portion likewise the foregoing description referring to FIG. 17(C). If this electrostatic image is developed by the developing device containing the Magenta toner, this toner is applied exclusively to the G-filter portion so that a Magenta toner image is formed, as in FIG. 17(D). In this case, too, it is quite natural that the developing density is regulated by changing the quantity or wavelength distribution of the light for the whole-surface exposure. As a result, a toner image, in which two colors are overlapped in a regulated density balance, is obtained. After the surface potential of the photosensitive member 4 is made uniform by the charging device likewise FIG. 17(D), moreover, the photosensitive member 4 is subjected to a whole-surface exposure in the red light obtained by combining the lamp 7 and the red filter so that the potential pattern having appeared in the R-filter portion for giving an image in a color complementary to red is developed by the developing device containing a cyan toner, thus forming a cyan toner image. Here, the regulation of the developing density is also conducted by changing the quantity or wavelength distribution of the light for the whole-surface exposure. Now, according to the foregoing description made with reference to FIG. 17(B), all the charges have disappeared from the R-filter portion s that no potential pattern is formed in that R-filter portion even by the whole-surface exposure in the red light. However, the foregoing description applies to the portion where the red component $L_R$ of the image exposing light is intense, but the potentials appear in other portions such as the blue image portion of the portion in dark red light to form the potential pattern thereby to effect the development with the cyan toner.

By the steps thus far described, the clear three-color toner image having neither color distorsion nor color indistinctness and excellent in density balance is formed on the photosensitive member 4. The toner image formed is transferred to and fixed on recording paper by the means known in the art.

The foregoing description resorts to the example, in which the n-type photo-semiconductor is used as the photoconductive layer 1 of the photosensitive member 4, but a p-type photo-semiconductor such as selenium can naturally be used. In this modification, the fundamental process is not changed although all the positive and negative polarities of the charges of the foregoing description are inverted. In either case, however, an optically uniform irradiation may be used together in case the charging device 5 finds it difficult to inject the charges into the photosensitive member 4.

By the methods thus far described, the full-color image having neither color distorsion nor color indistinctness is formed and is transferred to the recording paper by the well-known means until it is fixed.

Figure 24:
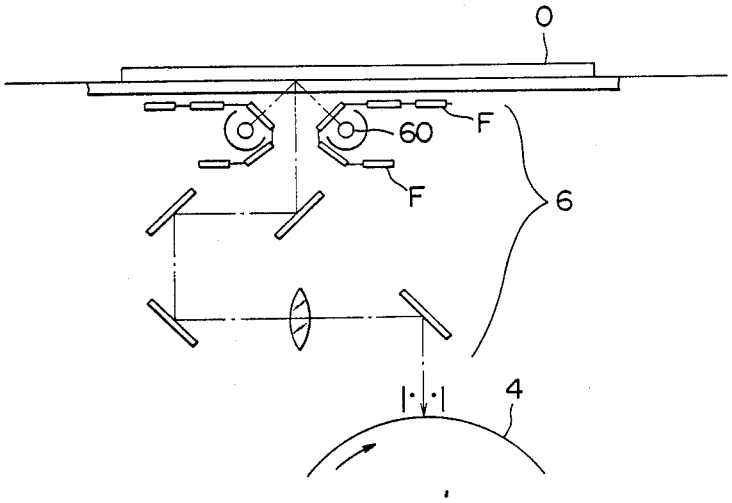
FIGS. 24 and 25 are partial views showing respective examples of an original projecting device in image exposing means of the copying apparatus of the present invention.
Figure 25:
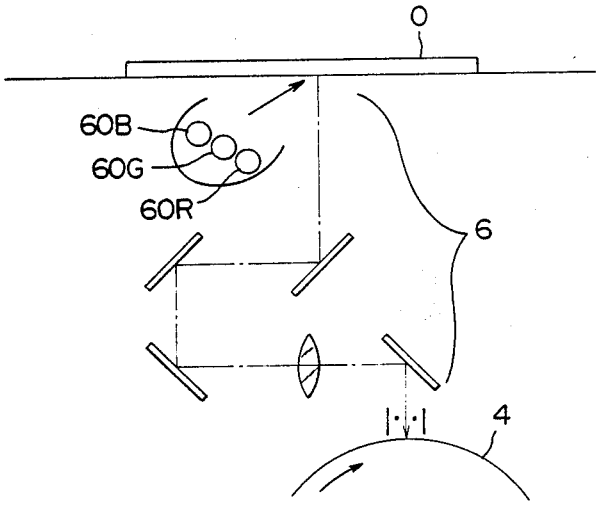

The density and color balance of the image thus reproduced are regulated in the image exposing device 6 of FIG. 24 by suitably switching those filter elements of a change-over filter F, which are arranged in parallel between chains at the two ends for dimming the light or changing the wavelength distribution, to change the quantity and wavelength distribution of the light, with which an image exposing lamp 60 irradiates an original O, so that the intensity distribution of the individual color components of the image exposing light is changed to change the intensity of the potential pattern formed by the whole-surface exposure. In addition, the filter F may be of the type in which it is switched in a circulated manner. In the image exposing device 6 of FIG. 25, moreover, the light emitting intensities of blue, green and red image exposing lamps 60B, 60G and 60R are so suitably regulated by changing their respective supply voltages that the intensity distribution of the individual color components of the image exposing light may be changed. It goes without saying that halogen or fluorescent lamps are used as the image exposing lamps 60, 60B, 60G and 60R and that a slit is used for regulating the quantity of light.

The switching operations of the filters and the regulations of the emission intensities of the exposing lamps thus far described may be performed by the method of detecting and controlling the colors by photosensors, by the method of switching or adjusting volumes by the user of the copying apparatus, by the method of switching the filters and controlling the emission intensities of the exposing lamps by means of a computer which is responsive to information concerning the tone of such a multicolor image and automatically detected by detecting means with reference to a reference multicolor image as has been formed in advance on the photosensitive member, so that the stabilized multicolor image can be obtained. In case the user intends to reproduce a desired color tone, on the other hand, it is preferable to provide an automatic feedback mechanism, by which the user is enabled to designate the saturation and lightness of color in control panel in a manner to facilitate their selection so that the aforementioned exposure and wavelength distribution may change.

By the methods thus far described, it is possible to reproduce the multicolor image which has neither color distorsion nor color indistinctness, which is excellent in reproducibility and which is clearer or can be changed in the color tone, as desired.

Incidentally, the multicolor copying apparatus of the present invention can naturally reproduce a monochromatic image likewise the multicolor copying apparatus of the prior art.

The situation, in which the original image is reproduced by the three-color separating method and by combining the toners of primaries thus far described, is tabulated in Table 1 in relation to the colors between the original and the reproduced images:

Next, the recording apparatus of FIGS. 19 to 22 for practising the method of the present invention will be described in the following.

Figure 19:
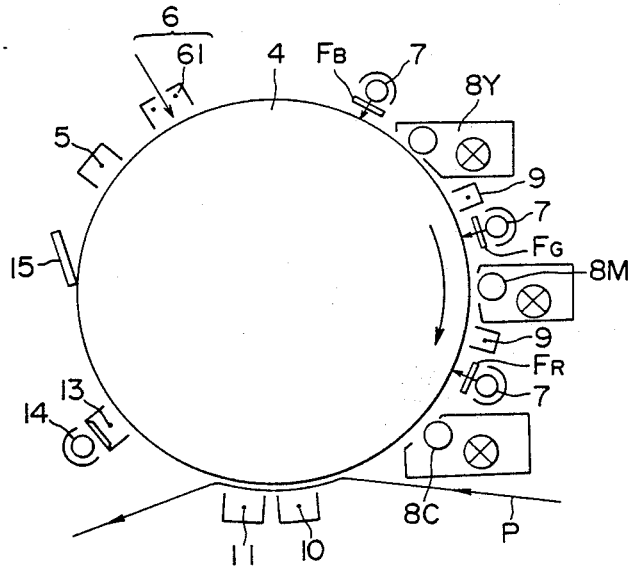
FIGS. 19, 20 and 22 are schematic front elevations showing respective examples of recording apparatus for practising the method of the present invention.
Figure 20:
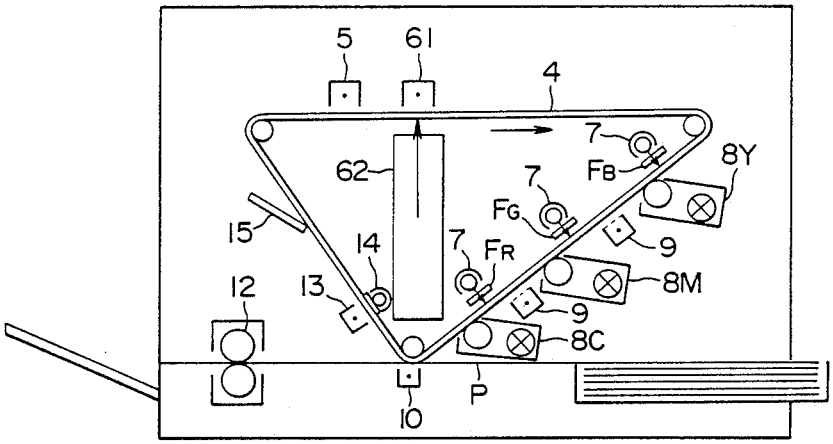
Figure 21:
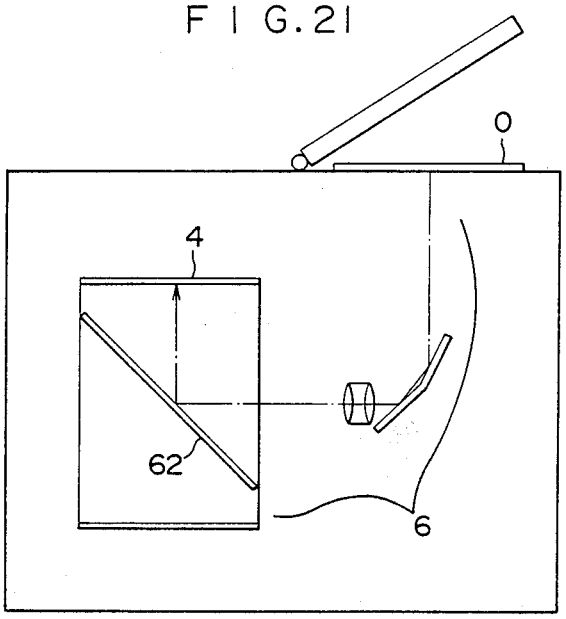
FIG. 21 is a schematic side elevation showing an image exposing portion of the recording apparatus of FIG. 20.
Figure 22:
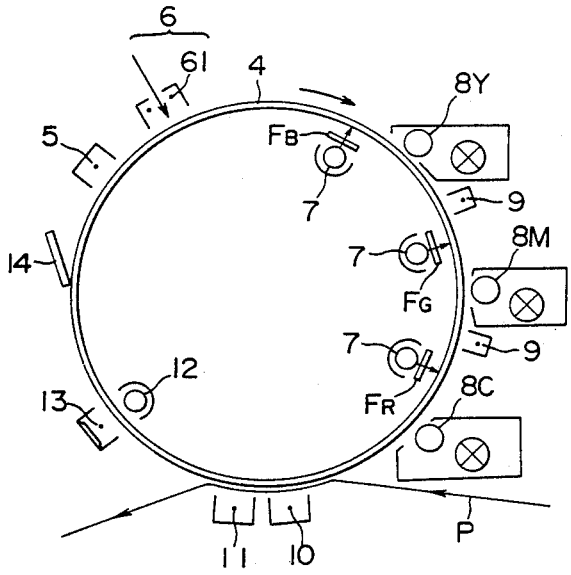

The photosensitive members 4 having the layer structures to FIGS. 1 to 4 or FIGS. 9 to 13 are used in the recording apparatus of FIG. 19; the photosensitive members 4 having the layer structures of FIGS. 5 to 13 are used in the recording apparatus of FIGS. 20 and 21; and the photosensitive members 4 having the layer structures of FIGS. 9 to 13 are used in the recording apparatus of FIG. 22. In FIGS. 19 to 22, the same reference numerals as those of FIG. 17 denote the parts having the same functions. In addition: reference letters $F_G$ denote a green filter; letters $F_R$ a red filter; characters 8M a developing device containing the Magenta toner; characters 8C a developing device containing the cyan toner; numeral 10 a transfer device for transferring the toner image formed on the photosensitive member 4, as has been described with reference to FIG. 17, to recording paper P; numeral 11 a separating device for separating the recording paper P bearing the transferred toner image from the photosensitive member 4; numeral 12 a fixing device for fixing the toner image to the recording paper P; numerals 13 and 14 a charge eliminator for subjecting the photosensitive member 4 after the transfer to a charge elimination and an exposer for the charge elimination, respectively; and numeral 15 a cleaning device for removing the residual toners from the surface of the photosensitive member 4. The toner

TABLE 1

| Original Image | White | | | Red | | | Green | | | Blue | | | Yellow | | | Magenta | | | Cyan | | | Black | | |
|---|---|---|---|---|---|---|---|---|---|---|---|---|---|---|---|---|---|---|---|---|---|---|---|---|
| Filter Layer | R | G | B | R | G | B | R | G | B | R | G | B | R | G | B | R | G | B | R | G | B | R | G | B |
| Image Exposure | | | | | ◌ | ◌ | ◌ | | ◌ | ◌ | ◌ | | | | ◌ | | ◌ | | ◌ | | | ◌ | ◌ | ◌ |
| Blue Whole-Surface Exposure | | | | | ↓ | ○ | ↓ | | ○ | ↓ | ↓ | | | | ○ | | ↓ | | ↓ | | | ↓ | ↓ | ○ |
| Yellow Development | | | | | ↓ | ● | ↓ | | ● | ↓ | ↓ | | | | ● | | ↓ | | ↓ | | | ↓ | ↓ | ● |
| Green Whole-Surface Exposure | | | | | ○ | | ↓ | | | ↓ | ○ | | | | | | ○ | | ↓ | | | ↓ | ○ | |
| Magenta Development | | | | | ● | | ↓ | | | ↓ | ● | | | | | | ● | | ↓ | | | ↓ | ● | |
| Red Whole-Surface Exposure | | | | | | | ○ | | | ○ | | | | | | | | | ○ | | | ○ | | |
| Cyan Development | | | | | | | ● | | | ● | | | | | | | | | ● | | | ● | | |
| Applied Toner | — | — | — | — | M | Y | C | — | Y | C | M | — | — | — | Y | — | M | — | C | — | — | C | M | Y |
| Reproduced Image | White | | | Red | | | Green | | | Blue | | | Yellow | | | Magenta | | | Cyan | | | Black | | |

In Table 1: reference symbol " ◌ " denotes that charges are present between the insulating layer and the photoconductive layer of the photosensitive member having been subjected to the image exposure; symbol "○" denotes that the surface potential of the photosensitive member is changed by the uniform exposure; and symbol " ● " denotes that the toners are applied. Moreover: reference symbol " ↓ " denotes the state in which the states of the upper columns are maintained as they are; the blanks denote the regions in which the light transmits through the insulating layer when in the image exposure so that no tone is applied; and reference letters Y, M and C in the columns of the "toners applied" denote that the yellow, Magenta and cyan toners are applied.

image forming steps in the recording apparatus thus constructed are apparent from the description referring to FIG. 17, and the transferring and fixing steps of the toner images and the charge eliminating and cleaning steps of the photosensitive member 4 are unchanged from those of the prior art, so that their further explanations will be omitted. In the recording apparatus of FIGS. 20 and 21, however, the discharger 61 is separated from the image exposing device 6 and is disposed at the side of the insulating layer outside of the belt-shaped photosensitive member 4, the image exposing device 6 conducts its image exposure at the portion, which is discharged by the discharger 61, from the side of the light transmissive, conductive layer having the filter layers inside of the photosensitive member 4 by means of a mirror 62. In any of the recording apparatus, the quantities of lights of the individual lamps 7 for the whole-surface exposures can be regulated independently, similarly or arbitrarily through the filters $F_B$, $F_G$ and $F_R$ so that the densities of the toner images obtained by the developments of the developing devices 8Y, 8M and 8C are regulated.

All of these copying apparatus can superpose the toner images in three colors at the maximum during one rotation of the photosensitive member 4 (and can also reproduce a monochromatic image and a two-color image likewise the multicolor copying apparatus of the prior art). The steps of forming the toner images in those copying apparatus are already apparent from the descriptions made with reference to FIGS. 17(A) to 17(E) and FIGS. 24 and 25, and the steps of transferring and fixing steps of the formed toner images and the steps of charge eliminating and cleaning the photosensitive member 4 are unchanged from those of the recording apparatus of the prior art. Therefore, their repeated explanations are omitted. In the copying apparatus of FIGS. 20 and 21, however, the image exposing device 6 conducts its image exposure by introducing the light reflected from the surface of the original 0 from the side of the light transmissive, conductive layer having the filter layers inside of the belt-shaped photosensitive member 4 by means of the mirror 62. At the same time, the discharger 61 disposed outside of the position where the image exposing light is incident discharges the side of the insulating layer of the photosensitive member 4 so that the photosensitive member 4 may be changed, as has been described with reference to FIG. 17(B). On the other hand, the copying apparatus of FIG. 22 is different from the copying apparatus of FIG. 19 in that the potential pattern is formed by uniformly exposing the back side of the photosensitive member 4 with a predetermined light. In these copying apparatus, it is quite natural that the image exposing device 6 can change the quantity and wavelength distribution of the light for projecting the original O, as has been described with reference to FIGS. 24 and 25.

The copying apparatus of the present invention should not be limited to the examples of FIGS. 19 to 22 but may be modified such that the toner image in one color is formed for each turn or reciprocation of the photosensitive member 4 so that the toner images can be superposed by the several turns or reciprocations. This copying apparatus is inferior in the high speed of reproduction of the multicolor image, but the charger 9 can be omitted to perform not only the image exposure but also the discharging action of the discharger 61. In addition, the whole-surface exposing device between the developing devices 8Y to 8C can be omitted by providing such a whole-surface exposing device in the position of the whole-surface exposing device composed of the lamp 7 and the filter $F_B$ in combination as is composed in combination of the lamp 7 and change-over filters in which the filters $F_B$, $F_G$ and $F_R$ are switched for use. As a result, the copying apparatus can be made far more compact than the copying apparatus of FIGS. 20 to 22, which in turn is made more compact than the copying apparatus of FIG. 19.

As has been described hereinbefore, the regulation of the color reproduction of the multi-color image in the present invention is conducted by changing the quantity or wavelength distribution of the whole-surface exposing light. The light sources for the whole-surface exposure may be exemplified by the halogen or fluorescent lamp, the EL or the LED, and the method of regulating the quantity of the whole-surface exposing light is exemplified by changing the supply voltage of the power source or by providing a slit or a dimming filter. The method of changing the wavelength distribution of the whole-surface exposing light is exemplified by switching the color filters. And, the modes for regulating the color reproduction of the multicolor image are exemplified by the following ones:

(1) The mode of using resistors $V_Y$, $V_M$ and Vhd C for regulating the quantities of the lights of the individual lamps on the panel of the copying machine so that the color balance may be regulated by operating those volumes;

(2) The mode of likewise using resistors $\alpha$, $\beta$ and $\gamma$ for regulating a predetermined combination of the individual lamps so that the regulations may be effected by operating those volumes; and (3) The mode of likewise providing volumes for regulating the quantities of the lights of all the lamps simultaneously to that the color tone may be controlled by operating those volumes. It is quite natural that the mode be included of providing all the resistors of the modes (1), (2) and (3) on the panel so that the color balance of the image obtained may be suitably regulated. Without resorting to the operations of the operator, moreover, color reproduction detecting means may be provided so that the aforementioned resistors may be controlled according to signals which are automatically outputted from a computer in the copying apparatus. These control methods can likewise be applied to the cases in which the image exposure is to be controlled or in case the charging conditions and the developing conditions are to be controlled, as will be described hereinafter.

As the developing material in the multicolor image forming method of the present invention, there can be used either the so-called "one-component developer" composed exclusively of the toners or the so-called "two-component developer" composed of the toners and their magnetic carrier. For the developments, the condition for directly rubbing with a magnetic brush. Especially at the second and later developments, in order to avoid the damage of the toner images, it is especially preferable to use the developing method, by which the developer layer is kept away of contact with the surface of the photosensitive member, as is disclosed in the individual Specifications of U.S. Pat. No. 3,893,418, Japanese Pat. Laid-Open No. 55-18656, Japanese Patent Applications Nos. 58-57446, 58-238295 and 58-238296. These methods conduct the developments under the conditions in which the one- or two-component developer containing a non-magnetic toner capable of freely selecting the coloring is used, in which an alternating electric field is established in the developing region, and in which the photosensitive member and the developer layer are kept away from contact with each other, i.e., in which the gap between the surface of the photosensitive member and the carrier of the developer layer of the developing device is made larger than the thickness of the developer layer in the developing region (i.e., the thickness under the condition with no potential difference between the photosensitive member and the developer carrier).

The color toners to be used for the developments can be exemplified by the toners for developing electrostatic images, which are prepared by the prior art technique and composed of such a known binding resin, a variety of coloring agents of chromatic or achromatic colors such as organic or inorganic pigments or dyes, and a variety of magnetic additives as are usually used in the toners. The carrier can be exemplified by a variety of known carriers such as magnetic carriers such as iron powder, ferrite powder, iron or ferrite powder coated with a resin, or a carrier prepared by dispersing the magnetic material into a resin, all of which are also usually used for the electrostatic image.

Moreover, the developing method, as has been disclosed in the Specifications of Japanese Patent Application Nos. 58-249669 and -240066 applied for patent by the present Applicant.

All the foregoing descriptions have been directed to the embodiments of the color copying apparatus using the so-called "three-color separation filters" and "primaries toners". However, the modes of embodiment of the present invention should not be limited thereto but can be applied to a wide variety of multicolor image recording apparatus and color photography printers. It goes without saying that the combination of the colors of the color separation filters and the colors of the toners corresponding thereto can be arbitrarily selected in accordance with the object. In the present invention, the color balance of the multicolor image to be reproduced can be regulated by relatively changing the discharging conditions of the discharger 61 of FIG. 17(B) and the charger 9. The reason why that color balance can be regulated will be first described with reference to FIG. 23.

Figure 23:
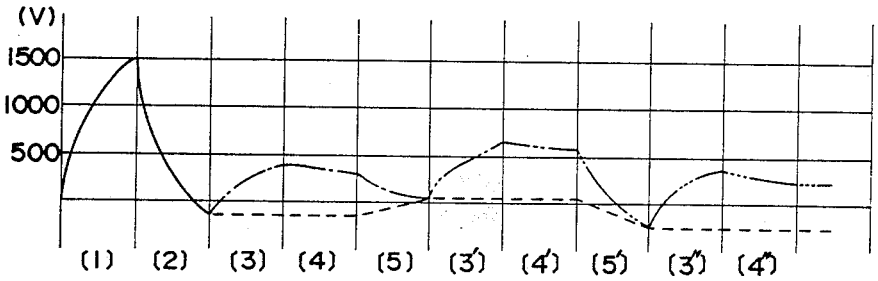
FIG. 23 is a graph depicting the potential change of the surface of the photosensitive member for explaining the possibility of adjusting color balance by changing the discharging conditions such as a recharge.

Reference numerals [1] to [5] appearing in FIG. 23 depict the change in the surface potential of the photosensitive member during the repetition of the steps of FIGS. 17(A) to 17(E) and the steps of FIGS. 17(C) to 17(E) similar to the former. The single-dotted curves and the broken curves at the steps [3] to [5] plot the potential changes of the black and while grounds formed by the uniform exposures with the blue light, respectively. The portion [3] plots the change resulting from the uniform exposure; the portion [4] the change resulting from the development with the yellow toner; and portion [5] the change resulting from the recharge. The double-dotted curves and the broken curves at steps [3'] to [5'] plot the potential changes of the black and white grounds, which are caused by the uniform exposure with the green light, respectively. The portion [3'] plots the change resulting from the uniform exposure; the portion [4'] the change resulting from the development with the Magenta toner; and the portion [5'] the change resulting from the recharge. The tripple-dotted curves and the broken curves appearing at the steps [3''] and [4''] likewise plot the potential changes of the black and white grounds, which are caused by the uniform exposure with the red light. The portion [3''] plots the change resulting from the uniform exposure, and the portion [4''] plots the change resulting from the development with the cyan toner.

In the shown embodiments, in order the surface potentials of the photosensitive member 4 may be controlled within a range of 600 to 100V when in the whole-surface exposure, i.e., at the steps [3], [3'] and [3''], the discharger 61 of the step [2] and at least one of the chargers 9 at the steps [5] and [5'], and the grid in case a discharge wire or a scorotron charger are so constructed that they can control the voltage applied. These constructions include those in which an a.c. voltage having a d.c. component or an a.c. voltage is applied to the discharge wire whereas a d.c. voltage is applied to a plate electrode, in case the a.c. discharger or charger is used, to control the voltage applied or a current.

If the surface potential of the photosensitive member 4 at the instant when the charging operation by the discharger 61 or the charger 9 is ended is high, as shown in FIG. 23, the surface potential in the subsequent whole-surface exposure is elevated. As a result, for example, the surface potential of the B-filter portion takes 400V if the whole-surface exposure with the blue light at the step [3] is conducted by setting the surface potential at −100V at the step [2], whereas the surface potential of the B-filter portion takes 500V if the whole-surface exposure at the step [3] is conducted by setting the surface potential at 0V at the step [2]. As a result, with the developing conditions being constant, the quantity of the yellow toner applied can be controlled such that the yellow toner is applied more for the latter case at the step [4]. In case the quantity of the Magenta toner applied is to be controlled, on the other hand, the surface potential of the G-filter portion takes 550V if the whole-surface exposure with the green light at the step [3'] is conducted by setting the surface potential at 150V at the step [5], whereas the surface potential of the G-filter portion takes 300V if the whole-surface exposure at the step [3'] is conducted by setting the surface potential at −100V at the step [5]. As a result, the Magenta toner is less applied for the latter case at the step [4']. In case the quantity of the cyan toner applied is to be controlled, moreover, the surface potential of the R-filter portion takes 450V if the whole-surface exposure with the red light at the step [3''] is conducted by setting the surface potential at 50 V at the step [5'], for example, whereas the surface potential of the R-filter portion takes −500V if the whole-surface exposure at the step [3''] is conducted by setting the surface potential at 0 V at the step [5'] so that the toner is applied more for the latter case.

As is apparent from the description thus far made, the quantities of the toners applied can be changed by making the discharger 61 of the step [2] and at least one of the chargers 9 at the steps [5] and [5'] variable for the charging conditions to produce a recorded image having a high reproducibility in the color balance of the original and to strengthen a specific color. Incidentally, the charger 9 can be omitted by making the discharger 61 take the position thereof by a plurality of turns or circulations, as will be described hereinafter.

In FIG. 23, the potential difference established by the uniform exposures at the steps [3] and [3'] is shown to have been eliminated by the recharges of the charger 9 at the steps [5] and [5'], but this corresponds to a preferable case, and that potential difference may not disappear completely. In this case, it is more preferable that the charge elimination is conducted by a corona discharger such as an a.c. corona discharger before the recharge for the development to effect the uniformity of the potential difference.

On the other hand, the potential difference established by the uniform whole-surface exposure with a specific light can be arbitrarily regulated by the characteristics of the light source lamp 7, the photosensitive member 4 and the filters, but it is preferably set at a substantially equal level.

The photosensitive member 4 having its surface potential uniformed into the state of FIG. 17(E) by the charger 9, as has been touched with reference to FIG. 23 is subjected like the step [3] to a whole-surface exposure with the green light which has been produced by passing the light of the lamp 7 through the green filter (at the step [3'] of FIG. 23). As a result, a potential pattern for forming an image in a color complementary to the green color is then formed, as has been described with reference to FIG. 17(C). If this electrostatic image is developed by the developing device containing the Magenta toner, this toner is applied exclusively to the G-filter portion so that the Magenta toner image is formed (at the step [4'] of FIG. 23) likewise FIG. 17(D). The color balance between that Magenta toner image and the yellow toner image formed previously is regulated by the method having been described with reference to FIG. 23. The surface of the photosensitive member 4 thus formed with the toner images in those two colors is further subjected to a discharge like FIG. 17(E) by the charger 9 to have its potential uniformed (at the step [5'] of FIG. 23) and is then subjected to a whole-surface exposure with the red light, which is produced by the combination of the lamp 7 and the red filter, to form the R-filter portion with a potential pattern for forming an image in a color complementary to red (at the step [3''] of FIG. 23). The discharging condition at this time by the charger 9 are changed, as has been described with reference to FIG. 23. As a result, if the electrostatic image in the R-filter portion is developed into a cyan toner image by the developing device containing the cyan toner (at the step [4''] of FIG. 23), a clear full-color image having neither color distorsion nor color indistinctness and excellent in the density balance of the three-color toner image and is formed on the photosensitive member 4. On the other hand, FIG. 17(B) shows the state, in which the image exposure is conducted by introducing a reflected light from the original 0 into the aforementioned charged portion of the photosensitive member 4 by the image exposing means 6 shown in FIG. 26 or 27 and by releasing the charges in an a.c. current or in a polarity opposite to that of the charger 5 by the discharger 61, i.e., especially the portion which is intensely influenced by the red component $L_R$ of the image exposing light incident upon the photosensitive member 4. The photosensitive member 4, as shown, has a layer structure, in which the insulating layer 2 has the filter layer *2a*, as shown in FIGS. 1 to 4 or FIGS. 9 to 13. In case the photosensitive member 4 has the layer structure in which the insulating layer 2 contains no filter layer, as shown in FIGS. 5 to 8, the image exposing light is incident from the side of the conductive layer 3 having the filter layer *3a*, as shown in the apparatus of FIGS. 20 and 21.

By the methods thus far described, a full-color image having neither color distorsion nor color indistinctness is formed and is transferred to the recording paper or the like by the means known in the art until it is fixed.

Figure 26:
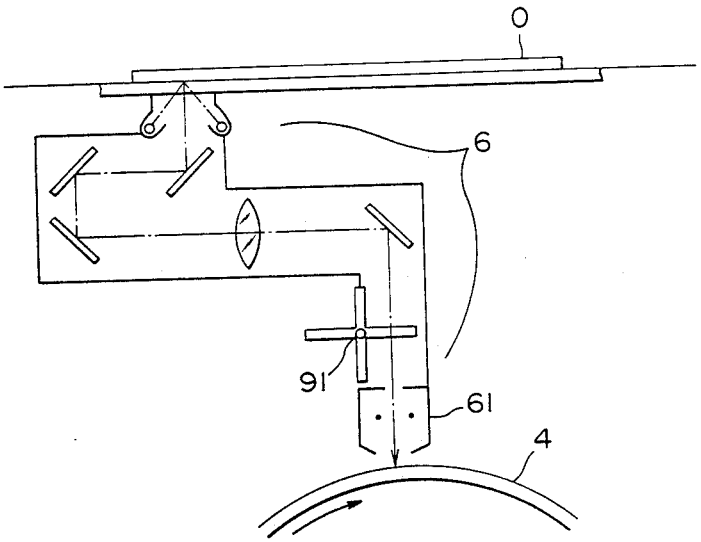
FIGS. 26 and 27 are partial views showing respective other examples of the original projecting device of the image exposing means of the copying apparatus of the present invention.
Figure 27:
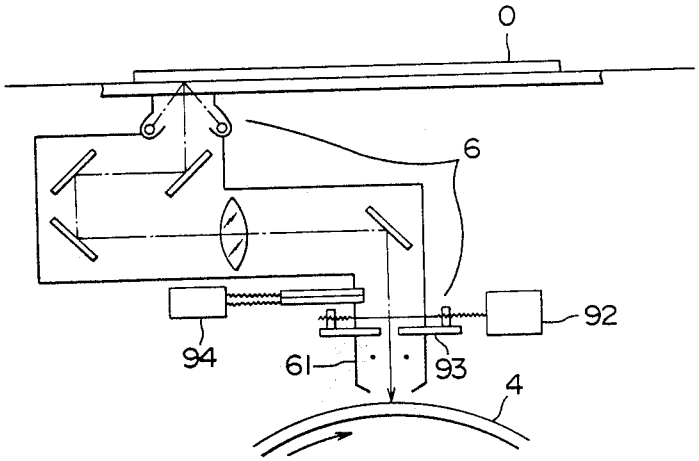

The regulations of the density and color balance of that reproduced image are conducted in the image exposing device 6 of FIG. 26 by switching turret type filter switching means 91 to insert either a dimming filter or a filter for changing the wavelength distribution into the incident optical path of the slit of the discharger 7 and in the image exposing device 6 of FIG. 27 either by moving a movable slit plate 93 by a slit width control motor 92 to change the upper opening of the discharger 7 or by inserting a filter for changing the wavelength distribution into the incident optical path of the discharger 61 by filter inserting means. If the quantity of the image exposing light is changed by changing the dimming filter or the slit width, more specifically, the intensity level of each color component is changed relatively uniformly, and the intensity level of the potential pattern formed by the whole-surface exposure is likewise changed so that the quantity of each color toner applied can be accordingly changed to change the density of the reproduced image. If the wavelength distribution of the image exposing light is changed by the filter for changing the wavelength distribution, on the other hand, the intensity level of a specific color component is especially changed, and the intensity of the potential pattern formed by the whole-surface exposure is likewise changed so that the quantity of the specific color toner applied can be especially changed to change the saturation and brightness of color of the reproduced image. The switching operation of such filter switching means 91 and the drive control of the slit width control motor 92 or the filter inserting means 94 may be conducted through the operations of the change-over switches or reaistors by the user Of the copying apparatus. Alternatively, the switching operations of the filter switching means 91 and the drive control of the slit width control motor 92 or the filter inserting means 92 may be automatically conducted by a computer on the basis of the information concerning the density and color tone of such a multicolor image, which are detected by detecting means as is formed in advance on the photosensitive member 4 from the reference multicolor image. Thus, it is possible to form an always stable multicolor image. If the user is enabled to easily grasp his desired saturation and brightness of color, on the other hand, it is preferable to provide such an automatic feedback mechanism that the color tone can be so designated by the control panel as to facilitate selection thereof and thet the aforementioned quantity and wavelength distribution of the exposing light may be accordingly shifted.

By the methods described above, it is possible to reproduce a multicolor image which has neither color distorsion nor color indistinctness, which is excellent in reproducibility, which is clearer and/or which has its color tone changed, as desired.

Figure 28:
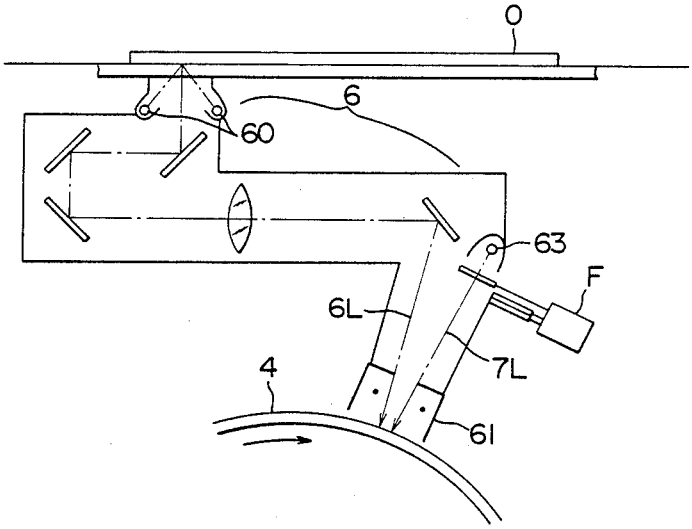
FIG. 28 is a view showing the image exposing portion of one example of means for subjecting the photosensitive member to a uniform exposure substantially simultaneously with the image exposure.

Incidentally, the multicolor copying apparatus of the present invention should not be limited to the foregoing embodiment but can change only one of the quantity and wavelength distribution of the image exposing light. Moreover, the multicolor copying apparatus can naturally reproduce a monochromatic image likewise the multicolor copying apparatus of the prior art. On the other hand, FIG. 17(B) shows the step at which the image exposure is conducted by introducing the reflected light as an image exposing light 6L from the original 0 into the aforementioned charged portion of the photosensitive member 4 by the image exposing device shown in FIG. 28, by simultaneously introducing a similar bias exposing light 7L by a bias exposing lamp 63, and by discharging a.c. charges or charges in a polarity opposite to that of the charger 5 by the discharger 61. For convenience of explanation, FIG. 17(B) shows the change in the charged state by the red component $6L_R$ in the image exposing light 6L especially in connection with the intense portion of the red component $6L_R$. The photosensitive member 4, as shown, has a layer structure in which the insulating layer 2 has the filter layer *2a* as shown in FIGS. 1 to 4 or FIGS. 9 to 13. FIG. 28 shows an example in which the quantity or wavelength distribution of the bias exposing light 7L is changed by passing the light of the bias exposing lamp 63 through either the dimming filter to be switched by the filter switching means F or the wavelength distribution changing filter. The regulations of the bias exposing light 7L should not be limited thereto but can be conducted by changing the light quantity by the slit, or by using three kinds of lamps for emitting blue, green and red lights as the bias exposing lamps to regulate the optical emissions of these lamps through the voltages applied thereto.

The surface potential E of the photosensitive member 4 at the aforementioned step of FIG. 17(B) is uniformed at not only at its portion, where the negative charges in the boundary between the photoconductive layer 1 and the insulating layer 2 have disappeared, but also at its portion, where the same charges are left, by the discharging operation of the discharger 61. This is because the positive charges in the surface of the insulating layer 2 are distributed in accordance with the negative charges in the boundary between the photoconductive layer 1 and the insulating layer 2 and are balanced with the same. This state of the photosensitive member 4 does not function as the electrostatic image. The operations thus far described are similar to the case in which the image exposing light 6L is given from the side of the conductive layer 3 having the filter layer 3*a*. Incidentally, in case the insulating layer 2 is transparent at the photosensitive members 4 of FIGS. 5 to 8, in which the image exposing light 6L is given from the side of the photoconductive layer 3, the bias exposing light 7L may be given from the side of the insulating layer 2 opposite to the image exposing light 6L. Thus, by using a light in a near infrared region as the bias exposing light 7L, the l values of the short and long wavelength components of the image exposing light 6L can be corrected to be uniform, as is disclosed in the Specification of Japanese Patent Laid-Open No. 54-7336.

The regulations of the density and color tone by the bias exposing light 7L may be manually conducted by operating the filter switching means F of FIG. 28 by the user of the copying apparatus but can easily adopt the automatic method in which the switching operations of the filters and the regulations of the emission intensity of the bias exposing lamp are conducted by a computer in accordance with the information concerning the color tone or density of such a multicolor image detected by scan detecting means as is disclosed in the Specification of Japanese Patent Publication No. 55-2610. In addition to those regulations by the bias exposing light 7L, on the other hand, the quantity and wavelength distribution of the image exposing light 6L can be changed. For this change, there can be adopted means for switching and inserting the dimming filter or the filter for changing the wavelength distribution between the image exposing lamp of FIG. 28 and the original O, for using three kinds of lamps for emitting blue, green and red lights as the image exposing lamp to change their emissions, or for switching and inserting the dimming filter or the filter for changing the wavelength distribution immediately before the image exposing light 6L is incident upon the photosensitive member 4. Of course, the dimming filter may be replaced by a slit. If such means for changing the image exposing light 6L is adopted, the range for regulating the image density or color tone can be further widened.

Since the steps of forming the toner images in those copying apparatus have already been made apparent by the descriptions referring to FIGS. 17 and 28, and since the steps of transferring and fixing the toner images formed and the steps eliminating the charges of and cleaning the photosensitive member 4 are not unchanged from those of the recording apparatus of the prior art, their repeated explanations are omitted. In the copying apparatus of FIGS. 20 and 21, however, the photosensitive member 4 is subjected to the changing operation described with reference to FIG. 17(B) by introducing the reflected light from the surface of the original 0 through the mirror 62 into the side of the light transmissive, conductive layer having the filter layer inside of the belt-shaped photosensitive member 4 by the image exposing means 6, by introducing the bias exposing light 7L into the insulating layer outside of the position, in which that image exposing light 6L is incident, through the filter of the turret-type filter switching means F by the bias exposing lamp 7, and by the discharging operation of the discharger 61. In these examples of FIGS. 20 and 21, the correction, as disclosed in the Specification of Japanese Patent Laid-Open No. 54-7336, can also be conducted by the bias exposing light 7L. On the other hand, the copying apparatus of FIGS. 19 and 22 use the image and bias exposing means, as shown in FIG. 28.

Figure 29:
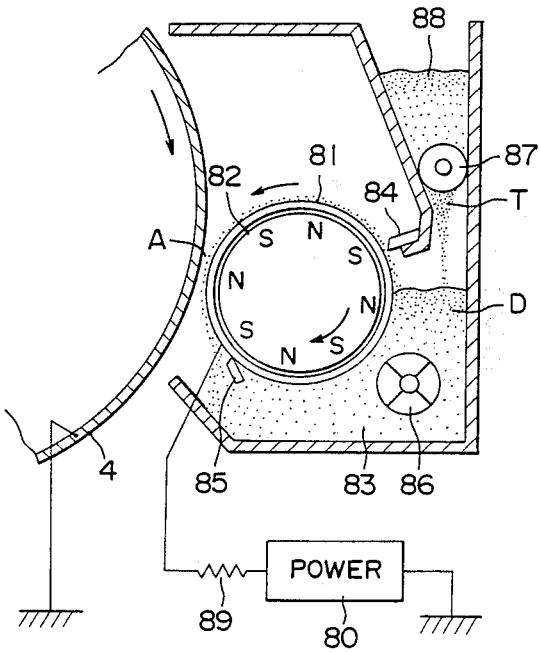
FIG. 29 is a schematic section showing a developing device for explaining a developing method to be used in the present invention.

For the development at the image forming steps of the present invention, the developing device, as shown in FIG. 29, is preferably used.

The developing device of FIG. 29 conducts its developing operation by mounting magnets 82 in a developing sleeve 81 made of a non-magnetic material such as aluminum or stainless steel, by turning the magnets 82 in the direction of arrow and the developing sleeve 81 in the opposite direction, by attracting a developer from a developer reservoir 83 to the surface of the developing sleeve 81 by the magnetic forces of the N and S magnetic poles arranged on the surface of the magnets 82 to carry the developer in the same direction as the turning direction of the developing sleeve 81, and by flying and applying the toner from the developer layer in a developing region A to the electrostatic image of the photosensitive member 4, the developer layer having a thickness regulated by a thickness regulating blade 84 composed of a magnetic substance or a nonmagnetic substance. A bias voltage is applied to the developing sleeve 81 by a bias power supply 80 to generate an electric field for controlling the transfer of the toner at the developing region A. Incidentally: reference numeral 85 denotes a cleaning blade for eliminating the developer layer having passed through the developing area A from the developing sleeve 81 to return it to the developer reservoir 83; numeral 86 an agitating blade for agitating the developer in the developer reservoir to make the developer uniform and to frictionally charge the toner; numeral 87 a toner supply roller for supplying the toner from a toner hopper 88 to the developer reservoir 83; and numeral 89 a protecting resistor.

Figure 30:
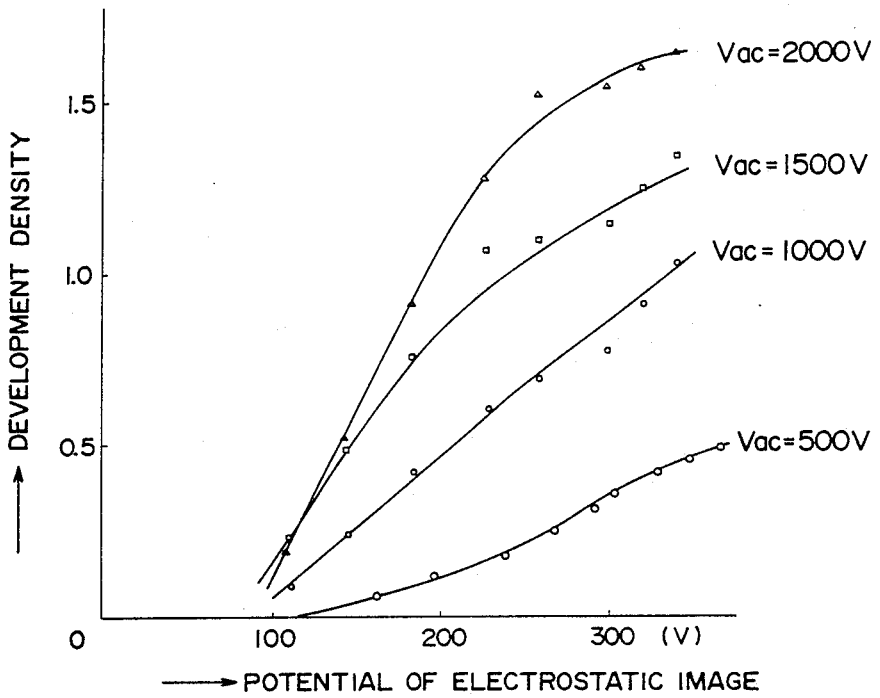
FIGS. 30 to 32 are development density graphs showing respective examples for adjusting color reproduction by changing the developing conditions.
Figure 31:
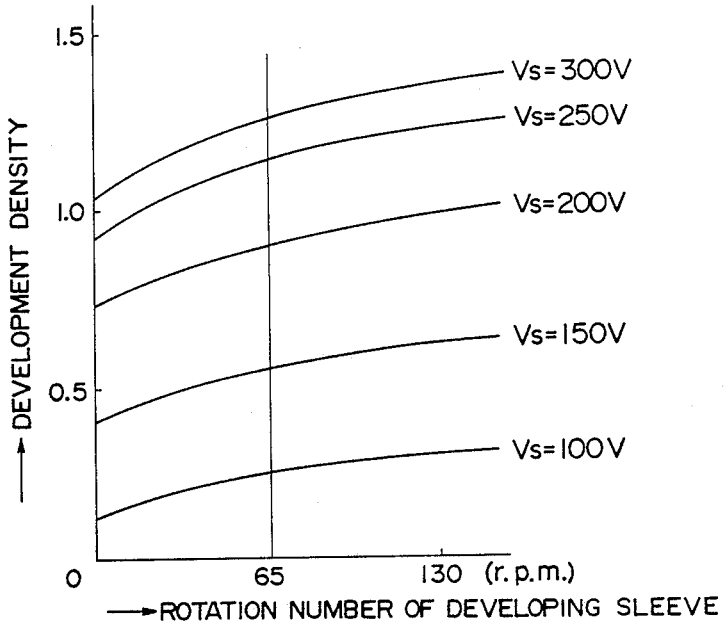
Figure 32:
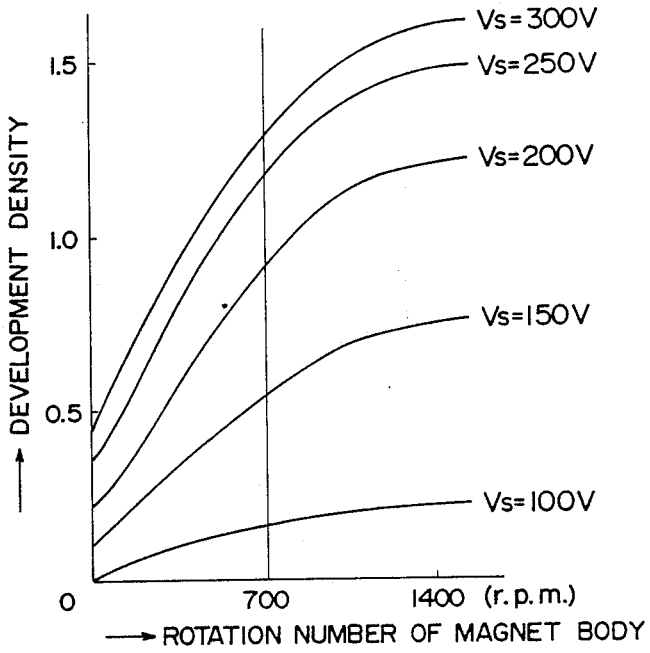

In this developing device, the quantity of the toner to be transferred from the developer layer to the photosensitive member 4 is controlled by changing the developing bias voltage to be applied for development to the developing sleeve 81 from the bias power supply 80, or the developing density, i.e., the color reproduction of the multicolor image can be regulated by changing the turning speed of the developing sleeve 81 and/or the magnets 82. FIG. 30 depicts that the developing density, i.e., the quantity of the color toner applied can be changed by changing the effective value Vac of the a.c. component of the developing bias, and FIGS. 31 and 32 depict that the developing density can be changed by changing the turning speeds of the developing sleeve and the magnets, respectively.

FIG. 30 depicts the results of the developments, which were conducted by applying the superposed bias voltage of a d.c. voltage of 100V and an a.c. voltage having a constant frequency of 2 KHz and different levels to the developing sleeve 81 having an external diameter of 30 mm by the bias power source 80 under the conditions: that the drum-shaped photosensitive member 4 was formed on the surface of its insulating layer 2 formed with the positive electrostatic image depicted on the abscissa and turned in the direction of arrow of FIG. 29 at the surface speed of 120 mm/sec; that the gap between the photosensitive member 4 and the developing sleeve 81, i.e., the gap of the developing region A was 1,000 μm; that the gap between the layer thickness regulating blade 84 made of a non-magnetic material and the developing sleeve 81 was 300 μm; that the number of revolutions of the magnets 82 having eight equi-distantly spaced N and S magnetic poles of flux density of 900 Gausses in the direction of arrow was 700 r.p.m.; that the number of revolutions of the developing sleeve 81 in the direction of arrow was 50 r.p.m.; and that the two-component developer composed of an insulating magnetic carrier having a weight-averaged particle diameter of about 30 μm and specific resistance of about $1\times10^{14}$ Ωcm and prepared by dispersing magnetic power into a resin and an insulating non-magnetic toner (or black toner) having an average particle diameter of about 13 μm and a specific resistance of $1\times10^{16}$ Ωcm for negative charging actions was used as the developer. FIGS. 30 indicates that the higher developing density can be obtained for the higher voltage of the a.c. component of the developing bias. FIG. 31 depicts the results which are obtained by the developments under the same conditions as those of FIG. 30 except that the a.c. component of the developing bias had a frequency of 1.5 KHz and a voltage of 1.5 KV and that the r.p.m. of the developing sleeve 81 in the direction of arrow was changed in various manners. In FIG. 31, reference letters Vs denote the surface potential of the photosensitive member 4, i.e., the potential of the electrostatic image. If the r.p.m. of the developing sleeve 81 in the direction of arrow is increased, the quantity of the toner to be supplied to the developing region A is increased so that the developing density is accordingly increased, as shown. FIG. 32 depicts the resutls which were obtained by developing under the same conditions as those of FIG. 31 except that the number of revolutions of the developing sleeve 81 in the direction of arrow was fixed at 65 r.p.m. whereas the r.p.m. of the magnets 82 in the direction of arrow was varied, and the reference letters Vs denote the potential of the electrostatic image. Even if the r.p.m. of the magnets 82 in the arrow direction is increased, the quantity of the toner supplied to the developing region A is increased so that the developing density is also increased, as depicted. As is apparent from FIG. 32, with the developing bias being varied, the color reproduction can be regulated by varying the numbers of revolutions of the developing sleeve 81 and/or the magnets 82. In the case of the developing bias, the developing density can also be regulated by varying the frequencies of the d.c. and a.c. components.

The regulations of the color reproduction of the multi-color image should not be limited to the example, in which the amplitude of the a.c. component of the developing bias is varied, but can be conducted by changing the level of the d.c. bias voltage, by varying the frequency or waveform of the a.c. component, and by combining the former two varying methods. Incidentally, in case the frequency of the a.c. component is to be varied, the developing density is dropped in accordance with the increase in the frequency, but the quantity of the toner image in each color to be applied may be regulated by changing the frequency in that range. The preferable range of the frequency to be used is from 0.3 KHz to 5 KHz. In case the developing density is to be regulated by varying the quantity of the toner to be supplied to the developing region A, not only the numbers of revolutions of the magnets 82 and the developing sleeve 81 but also the gap of the layer thickness regulating blade from the developing sleeve 81 can be varied. In case the two-component developer is used as the developer, on the other hand, the quantity of the toner to be supplied to the developing region is varied by varying the ratio of the toner to the carrier so that the developing density can also be regulated. Since the regulations of the developing density can be conducted easily and effectively, however, it is preferable to use the method of changing the developing bias or changing the number of revolutions of the magnets 82 or the developing sleeve 81. Moreover, it is quite natural that the developing devices 8Y to 8C can vary the developing conditions and the quantity of the toner to be supplied to the developing region, as has been described with reference to FIGS. 29 to 32, to regulate the color reproduction of the multicolor image. This color reproduction regulations will be exemplified in the following:

(1) Regulations by Developing Bias (a) Regulations by Voltage of A.C. Component

The conditions other than those in the following Table are the same as those described with reference to FIG. 30 except that the voltage of the d.c. component was set at 150V, and the toner density of the developer in the following Examples 1 to 3 are under the common conditions:

TABLE 2

| Examples | Developing Device | A.C. Voltage (KV) |
|---|---|---|
| 1 | 8Y | 1.5 |
| | 8M | 1.5 |
| | 8C | 1.5 |
| 2 | 8Y | 2.0 |
| | 8M | 1.2 |
| | 8C | 1.2 |
| 3 | 8Y | 1.7 |
| | 8M | 1.7 |
| | 8C | 1.2 |

The Example 1 can produce a recorded image which has a high reproducibility of the color tone of the original image; the Example 2 can produce a recorded image which has its yellow color stressed; and the Example 3 can produce a recorded image which has its red color stressed.

(b) Regulations by Voltage of D.C. Component

The conditions other than those of the following Table are the same as those of Table 2 except that the voltage of the a.c. component was set at 1.5 KV.

TABLE 3

| Examples | Developing Device | D.C. Voltage (V) |
|---|---|---|
| 1 | 8Y | 150 |
| | 8M | 150 |
| | 8C | 150 |
| 2 | 8Y | 50 |
| | 8M | 200 |

TABLE 3-continued

| Examples | Developing Device | D.C. Voltage (V) |
|---|---|---|
| | 8C | 200 |
| 3 | 8Y | 75 |
| | 8M | 75 |
| | 8C | 200 |

The recorded images according to these Examples 1 to 3 exhibit color tones similar to those of the Examples 1 to 3 of Table 2, respectively.

(c) Regulations by Frequency of A.C. Component

The conditions other than those of the following Table are the same as those of Table 2 except the voltage of the a.c. component was set at 1.5 KV.

TABLE 4

| Examples | Developing Device | Frequency (KHz) |
|---|---|---|
| 1 | 8Y | 2 |
| | 8M | 2 |
| | 8C | 2 |
| 2 | 8Y | 1 |
| | 8M | 2.5 |
| | 8C | 2.5 |
| 3 | 8Y | 1.5 |
| | 8M | 1.5 |
| | 8C | 2.5 |

The results according to these Examples 1 to 3 are similar to the Examples 1 to 3 of Table 2.

(2) Regulations by R.P.M. of Magnets

The conditions other than those of the following Table are the same as those described with reference to FIG. 32.

TABLE 5

| Examples | Developing Device | R.P.M. of Magnets |
|---|---|---|
| 1 | 8Y | 700 |
| | 8M | 700 |
| | 8C | 700 |
| 2 | 8Y | 1,000 |
| | 8M | 500 |
| | 8C | 500 |
| 3 | 8Y | 900 |
| | 8M | 900 |
| | 8C | 600 |

The results according to these Examples 1 to 3 are similar to those of the Examples 1 to 3 of Table 2.

The recording apparatus for practising the method of the present invention should not be limited to the examples of FIGS. 19 to 22 but may be modified such that a toner image in each color is formed for each turn or repetition of the photosensitive member 4. In this recording apparatus, the charger 9 can be omitted and replaced by the discharger 61 for both image exposing and discharging operations, and a whole-surface exposing device composed in combination of the lamp 7 and the change-over filters having its filters $F_B$, $F_G$ and $F_R$ switched can be disposed in the position of the whole-surface exposing device composed in combination of the lamp 7 and the filter $F_B$ so that the whole-surface exposing device between the developing devices 8Y to 8C can be omitted.

In the present invention, the developing conditions and the quantity of the toner to be supplied to the developing region can be varied by manually operating either the resistors for varying the output of the bias power supply or the speed-change mechanism such as the developing sleeve by the operator of the recording apparatus. In an alternative, a multicolor image is formed in advance on the photosensitive member in accordance with the reference multicolor image and has its color tone detected by detecting means so that the computer in the recording apparatus may automatically conduct the feedback control of the aforementioned developing density control means in accordance with the information detected. In order for the user to easily attain his desired color tone, on the other hand, it is preferable to use an automatic feedback mechanism, in which the color tone is designated by the control panel so that it may be easily selected, whereby the developing bias or the r.p.m. of the magnets are suitably shifted in accordance with the designation.

In the method of the present invention, the developer to be used in the developing apparatus need not be limited to the aforementioned two-component developer but may be a one-component developer composed exclusively of a toner. The preferred developer and developing method can be exemplified by those which are disclosed in the individual Specifications of U.S. Pat. No. 3,893,418 and Japanese Patent Laid-Open No. 55-18656, especially, Japanese Patent Application Nos 58-57446, 58-183152 and 58-184381, and Japanese Patent Application Nos. 58-238295 and 58-238296.

INDUSTRIAL APPLICABILITY

According to the present invention, there can be attained excellent effects that the number of times of the repetition of the whole-surface charging and image exposing operation can be reduced to once although several operations have been required in the prior art so that no color distorsion is caused to simplify the regulations of the color balance and the density thereby to form a high-quality image, and that it is possible to reduce the size of the multicolor electrophotographic apparatus to speed up its operations and to improve its reliability.

We claim:

1. A method of forming a multicolor image by repeating such whole-surface exposure and development on a multi-color image forming photosensitive member, which has: an insulating layer on one side of a photoconductive layer; a conductive layer on the other side, at least one of said insulating layer and said conductive layer being light transmissive and comprising a plurality of kinds of filters, as will produce a potential pattern in a portion of a specific kind one of the filters of said photosensitive member, after said photosensitive member has been charged and subjected to an image exposure, characterized in that said photosensitive member is recharged before the second and layer whole-surface exposure so that the surface potential of the photosensitive member is made uniform substantially and at least one of said image exposing, whole-surface exposing and developing steps is made variable to control the color reproduction of said multicolor image.

2. A multicolor image forming method as set forth in claim 1, characterized in that the density of a subsequent developement is adjusted by changing the quantity of light and/or spectral distribution of said whole-surface exposure.

3. A multicolor image forming method as set forth in claim 1, characterized in that the color reproduction of said multicolor image is adjusted by changing the conditions of said development.

4. A multicolor image forming method as set forth in claim 1, characterized in that the color reproduction of said multicolor image is adjusted by changing a developing electric field to be established between said photosensitive member and a developer carrier of a developing device.

5. A method of forming a multicolor image by repeating such whole-surface exposure and developement on a multi-color image forming photosensitive member, which has: an insulating layer on one side of a photoconductive layer; a conductive layer on the other side, at least one of said insulating layer and said conductive layer being optically transparent and comprising a plurality of kinds of filters, in a manner to recharge said photosensitive member before the second and later whole-surface exposures as will produce a potential pattern in a portion of a specific kind one of the filters of said photosensitive member, after said photosensitive member has been charged and subjected to an image exposure, characterized in that whole-surface exposure of said photosensitive member is recharged before the second and later whole-surface exposure so that the surface potential of the photosensitive member is made uniform substantially and at least one of said charging conditions is made variable to adjust the color balance of said multicolor image.

6. A copying apparatus for forming a multicolor image by repeating such whole-surface exposure and potential pattern developement on a multicolor image forming photosensitive member, which has: an insulating layer on one side of a photoconductive layer; a conductive layer on the other side, at least one of said insulating layer and said conductive layer being light transmissive and comprising a plurality of kinds of filters, as will produce a potential pattern in a portion of a specific kind one of the filters of said photosensitive member, after said photosensitive member has been charged and subjected to an image exposure, characterized in that said photosensitive member is recharged before the second and later whole-surface exposure so that the surface potential of the photosensitive member is made uniform substantially and image exposing means for projecting an original to effect said image exposure can change the quantity or wavelength distribution of light for projecting said original.

7. A multicolor copying apparatus as set forth in claim 6, characterized in that said image exposing means includes means interposed between said original and said photosensitive member for changing the quantity or spectral distribution of the light which is incident upon said photosensitive member.

8. A multicolor copying apparatus as set forth in claim 6, characterized by means for subjecting said photosensitive member to a uniform exposure substantially simultaneously with said image exposure to adjust the quantity or spectral distribution of the exposing light by said means.

* * * * *